United States Patent [19]

Grosskreuz et al.

[11] Patent Number: 4,497,155

[45] Date of Patent: Feb. 5, 1985

[54] PLUG SCREWING-IN DEVICE FOR BARRELS

[75] Inventors: Gerhard Grosskreuz, Hamburg; Arndt Lässig, Schenefeld bei Hamburg, both of Fed. Rep. of Germany

[73] Assignee: Grosskreuz Abfülltechnik GmbH, Schenefeld, Fed. Rep. of Germany

[21] Appl. No.: 377,567

[22] Filed: May 12, 1982

[30] Foreign Application Priority Data

May 14, 1981 [DE] Fed. Rep. of Germany ..... 3119286

[51] Int. Cl.[3] ..... B65B 7/28; B67B 1/06

[52] U.S. Cl. ..... 53/331.5; 53/367

[58] Field of Search ..... 53/331.5, 367, 319, 53/328, 330

[56] References Cited

U.S. PATENT DOCUMENTS

| | | | |
|---|---|---|---|
| 2,135,212 | 11/1938 | Kantor | 53/367 X |
| 2,731,185 | 1/1956 | Ranney et al. | 53/367 X |
| 3,662,519 | 5/1972 | Adams | 53/367 X |
| 3,946,540 | 3/1976 | Solberg et al. | 53/367 X |

*Primary Examiner*—Horace M. Culver

*Attorney, Agent, or Firm*—Toren, McGeady and Stanger

[57] ABSTRACT

A plug screwing-in device provides fully automatic screwing of plugs into the thread of a bunghole connecting piece located on a barrel bunghole, accompanied by the simultaneous, automatic centering and adaptation to any sloping position of the plug. For this purpose a centering and screw head is provided with an external centering ring and with a screw head arranged in the inner area of the ring, and the centering ring provided with a plug holding device can be raised counter to a spring force and is connected by means of a driving shaft and an intermediately connected universal joint with a drive mechanism.

3 Claims, 2 Drawing Figures

PLUG SCREWING-IN DEVICE FOR BARRELS

BACKGROUND OF THE INVENTION

The invention relates to a plug screwing-in device for barrels or drums.

Barrels and drums to be filled with liquids are, in a known manner, supplied with screwed-on plugs. It is, therefore, necessary to remove these plugs and screw them on again after filling. The barrels must be precisely aligned on a supply belt or the like of the filling mechanism, because there is otherwise a risk of the liquid flowing over the barrel and not into the bunghole. The opening and closing of bungholes is very labour-consuming in the case of the known filling mechanisms.

For closing the filling opening of a barrel or the like with the aid of a device for inserting and fixing a plug in the opening, a closing device is known in which both the device for inserting the plug and also the position determining device must be spaced from one another in such a way that they are freely movable upwards and downwards, as well as in accordance with polar coordinates with respect to a fixed point in a plane perpendicular to the upwardly an downwardly directed movement. In addition, this known device has a gripping device in order to prevent the free movement of the devices for inserting the plug and for determining the position. Furthermore, a drive mechanism is provided, which is suitable for the plug insertion and positioning, when the gripping device prevents the free movement, only in a linear manner and necessarily by a distance corresponding to that between the two devices. This closing device has a very large size. In order to obtain adequate stength for the precise mounting of the movable components, it is necessary for the construction to be very complicated. In addition, the energy requirement for operating this closing device is very great because on centering, the complete frame must always be pivoted about an axis on the support device (DOS No. 18 17 237).

In addition, a further known cover closing and container filling device has a very complicated construction and is very complicated to use (U.S. Pat. No. 29 83 089).

Furthermore, a device for closing containers with an eccentrically arranged spout is known, which is characterized by a prime mover, which can be moved between an inoperative position and an operative position in which a centering device carried by this prime mover engages in the periphery of the container cover wall, which has an eccentric spout in such a way that a rotary output shaft of the prime mover is brought and held in a position coaxial to the container. A scanning device which is held eccentrically by the shaft and as part of the latter is displaceable therewith about a periphery, whose centre point is located on the container axis and whose radius is equal to the spacing between the spout axis and the container axis, up to an engagement position with the spout, and by a sealing head held eccentrically by the shaft in a coaxial position to the scanning device and displaceable along its own axis between an inoperative position and an operative position in which there is engagement with the spout. This device permits the closing of containers with eccentric spouts, the position of the spout being scanned with a device which facilitates and accelerates said scanning operation. At the same time a further device ensures that the complete working cycle of the device takes place completely automatically. However, in order to perform all these functions, the known device has a plurality of complicated components (DOS No. 22 10 753).

Another known device for fitting screwcaps to the bungholes of barrels, with an air or beam vertically movable by a lifting device and pivotable about a vertical axis and with a centering device, as well as a closing device which, by pivoting the arm or beam, can be successively brought over the bunghole of a barrel, is constructed in such a way that the centering device is detachably connected to the arm by means of a receiving flange and on the latter is provided a holding tube with joints for detecting fingers on the outer wall, the shanks of said fingers being guided through openings in the holding tube casing and held together by means of an elastic ring of rubber or the like and whose surface portions remote from the holding tube are risingly convex towards the centre axis of said tube and with guide pins arranged coaxially to the centre axis of the tube, that centrally to the holding tube a centering mandrel can be vertically moved up to engagement with the shanks of the detecting fingers through an opening in the receiving flange by means of a pneumatically or hydraulically acting lifting cylinder, and that the closing device has a suction head for exposing the barrel closure cover to a suction action and a screw head for screwing said cover on to the thread of the bunghole support located on the bunghole on which is arranged an end portion of a receiving tube, whose other end portion is fixed to a rotary drive shaft. Such a device is intended to make it possible not only to position the closing cover on the bunghole after filling the vessel and then screw it down, but also to bring about the necessary motion and force transfer processes by means of hydraulically or pneumatically acting control elements without using long and difficultly manufacturable threaded spindles or the like, so that even with small constructional sizes high power levels can be transferred (DAS No. 25 40 864).

BRIEF SUMMARY OF THE INVENTION

The present invention solves the problem of providing a plug screwing-in device for barrels which automatically centres the screw head on the bunghole and makes an adjustment if the plug slopes.

For solving this problem a plug screwing-in device for barrels is proposed, which is constructed in such a way that it has a centering and screw head with an external centering ring and with a screw head arranged in the inner area of the centering ring. The centering ring is raisable counter to spring tension with respect to the screw head and is provided with a plug holding device. The screw head is connected by means of a driving shaft with an intermediately connected universal gear and a driving mechanism.

The invention also relates to a development in which the plug screwing-in device comprises a support frame with an upper mounting plate and a lower mounting plate, on which is arranged a centering plate with a circular opening tapering conically inwardly in the downward direction of the centering and screw head, whereby in the opening is arranged a correspondingly profiled moulded part carrying at its bottom end the centering ring and which is connected to a guide plate located above the centering plate and which is held in longitudinally displaceable manner against the tension of springs on at least three guide bolts fixed to the lower mounting plate of the supporting frame, the screw head is connected to the driving mechanism by means of a driving shaft rotatably mounted within the moulded part and the driving shaft has the universal joint.

By means of a device constructed in this way, it is possible to screw plugs fully automatically into the thread of the bunghole connecting piece arranged on the barrel bunghole, whilst there is simultaneously an automatic centering and adjustment for any slope of the plug. Centering takes place by applying the centering ring of the centering and screw head to the upper rim of the bunghole connecting piece, accompanied by simultaneous bearing on the barrel cover plate. For centering purposes the centering ring is moved upwards out of its centering mounting support, so that the actual screw head can be automatically aligned and adjusted on the plug by means of the universal joint so that its longitudinal axis is perpendicular to the plane formed by the upper surface of the plug. By means of the universal joint the screw head can also be aligned on a sloping plug. This compensates for any sloping position and ensures completely satisfactory screwing in of the plug. There is no need for separate precentering. Through integrating the screw head into the centering device, an efficient plug screwing-in device is provided, which has very small constructional dimensions and can be manufactured at limited cost.

Advantageous further developments of the invention are described in the subclaims.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1:
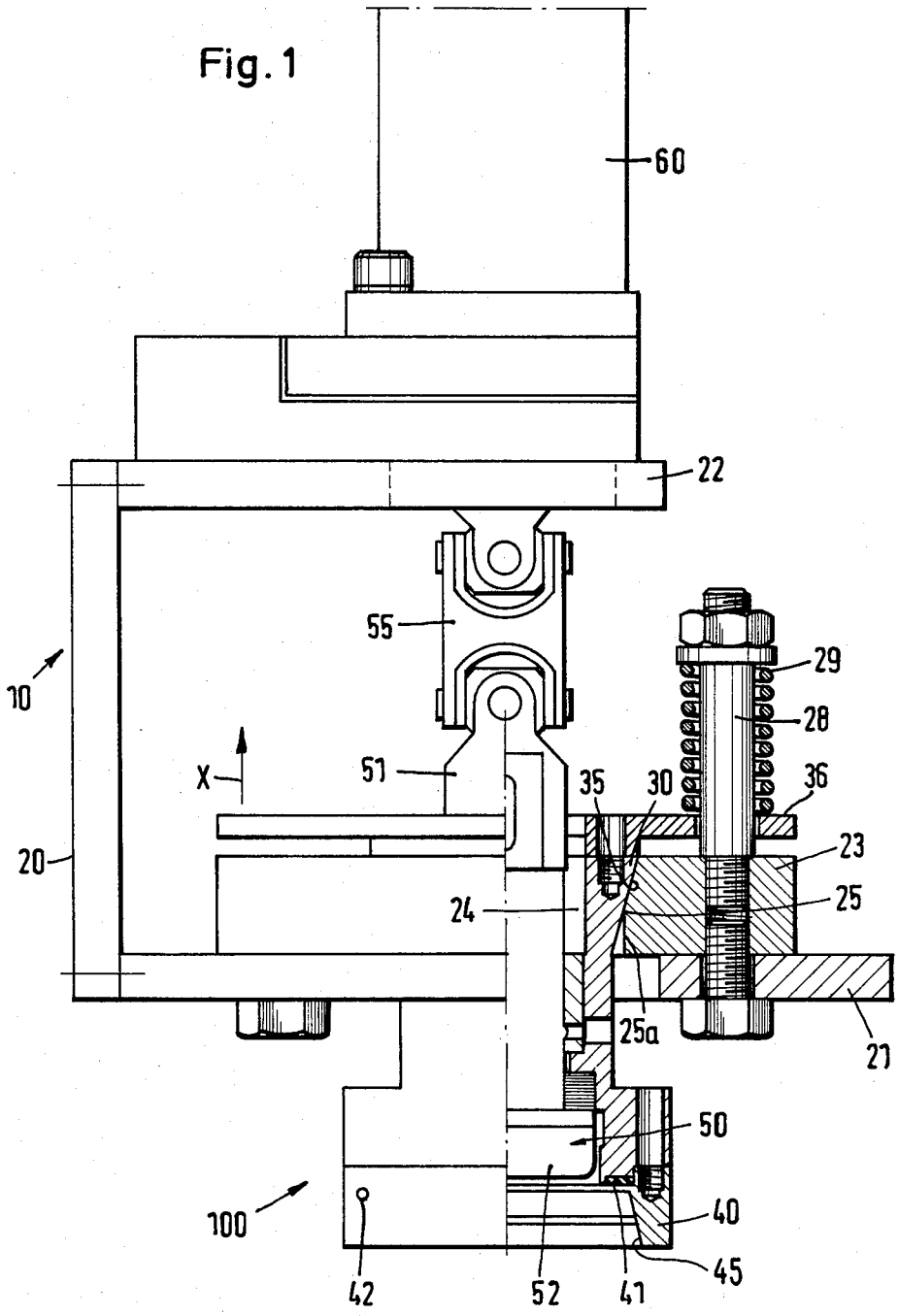
FIG. 1 partly in elevation and partly in vertical section the plug screwing-in device.

Device 10 according to FIG. 1 comprises a supporting frame 20 in the form of a U-shaped frame having a lower mounting plate 21 and an upper mounting plate 22 above it.

A centering plate 23 having a circular opening 24 is placed on the lower mounting plate 21. The inner wall surface 25 bounding opening 24 tapers conically downwards and, as shown at 25*a* in FIG. 1, said conical inner wall surface 25 can pass into a lower vertical wall portion.

Into the circular opening 24 of centering plate 23 is placed a moulded part 30 having a conically downwardly tapering outer wall surface 35, so that when molded part 30 is placed in opening 24, the conical outer wall surface 35 of part 30 engages the conical inner wall surface 25 of centering plate 23.

Figure 2:
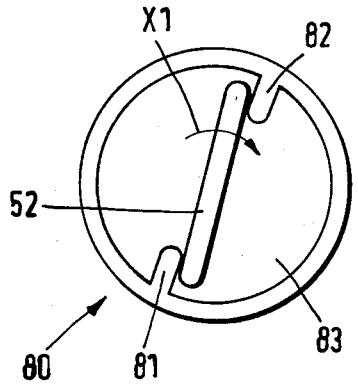
FIG. 2 in elevation from above a plug with engaging driving tongue on the centering and screw head.

Moulded part 30 is extended downwards and carries at its lower free end a centering ring 40, whose inner circular wall surface 45 is constructed conically. The inner area surrounded by centering ring 40 serves to receive a plug 80 as shown in FIG. 2. Centering ring 40 also has a plug holding device 41, which is constructed as a suction device and is connected to a vacuum production means by means of a connecting socket 42. By means of this suction device the screweddown plug 80 is engaged and secured by the centering ring 40.

Moulded part 30 is extended upwards through centering plate 23 and is connected to a guide plate 36, resting on centering plate 23. Guide plate 36 is held on guide bolts 28 in such a way that plate 36 is upwardly displaceable in the direction of arrow X and can therefore be raised. Advantageously, there are three guide bolts 28, equidistantly distributed in the lower mounting plate 21 of supporting frame 20 and passed through centering plate 23. On their shanks, guide bolts 28 carry springs 29, which bear on guide plate 36 in such a way that on raising plate 36 in the direction of arrow X the springs 29 are compressed, whereby after removing the pressure exerted from below on centering ring 40 by means of springs 29, guide plate 36 with moulded part 30 and centering ring 40 is moved downwardly back into its initial position.

Centering and screw head 100 includes the centering ring 40 and the screw head 50, which is freely rotatable in the inner area of ring 40 and is longitudinally displaceable (FIG. 1) relative to the centering ring. By means of a driving shaft 51 screw head 50 is driven by a driving mechanism 60, located in supporting frame 20 on upper mounting plate 22. Driving shaft 51 leading to screw head 50 is passed through a central longitudinal bore in moulded part 30. Accordingly, molded part 30 is constructed in sleeve-like manner in order to produce the longitudinal bore through which driving shaft 51 is passed. Driving shaft 51 is mounted by means of bushes, seals, etc.

Driving shaft 51 comprises two shaft portions interconnected by means of an intermediate universal joint 55. Through the use of this universal joint 55 it is possible to adjust screw head 50 to all slopes of the plug.

Driving mechanism 60 for the driving shaft 51 can be constituted by hydraulic, electromotive, compressed air or otherwise constructed drives. Screw head 50 has in its lower area a driving tongue 52, to which further reference will be made hereinafter (FIGS. 1 and 2).

The plug screwing-in device functions as follows. Firstly plug 80 is separately lowered beneath the centering and screw head 100 by means of pneumatic cylinders using a feeder, which is not shown in the drawing. When the previously aligned barrel with its bunghole has passed beneath the centering and screw head 100, the latter is lowered on to the screw cap or plug 80 and the latter is sucked by vacuum into the inner area of centering ring 40. This process is time-controlled. At the end of the set time, the plug transfer means returns to take up the next plug. The centering and screw head is moved by means of a further air cylinder over the barrel bunghole. This is followed by centering by means of centering ring 40. Centering ring 40 is now raised in its guide with moulded member 30 and is aligned in accordance with the bunghole. As a result of its gimbal mounting, screw head 50 can adapt to the centering movements of centering ring 40. When ring 40 is raised, the actual screw head 50 remains stationary, but it can still adapt to sloping positions of the plug as a result of its gimbal mounting, thereby compensating such positions. When centering ring 40 has been raised, guided in centering plate 23, it is also possible to align the screw head 50 through the gimbal mounting and using universal joint 55. This is followed by alignment with the bunghole and the plug. If the centering ring 40 is raised, screw head 50 remains in position, because the latter does not participate in the lifting movement of moulded member 30 with centering ring 40. As screw head 50 does not participate in this lifting movement, the screw head and its driving tongue 50 can engage in plug 80, in the manner shown in FIG. 2. Universal joint 55 also permits an automatic alignment or adjustment to a sloping position of the plug. Plug 80 is constructed in per se known manner and has on its cover face a disk-shaped depression 83, in the vicinity of which are provided two facing flange-like shaped-on pieces 81, 82, so that tongue 52 of head 50 in an approximately diagonally directed manner engages on one side of piece 81 and on the opposite side of piece 82 in such a way that when screw head 50 rotates in the direction of arrow X1, plug 80 also participates in this rotary movement.

As stated hereinbefore, on raising the centering and screw head 100, i.e. centering ring 40, the screw head 50 with the driving tongue 52 remains stationary and consequently can engage the shaped-on pieces or dogs 81, 82 of plug 80. By means of a timing circuit not shown in the drawings, driving device 60 is switched on, so that screw head 50 can be rotated. Simultaneously the vacuum line of the suction device or the plug holding device 41 is vented and the plug can be screwed into the bunghole connecting piece on the bunghole. By means of an adjustable torque switch the screwing process is brought to an end, the centering and screw head 100 returns to its initial position, i.e. screw head 50 and centering ring 40 assume the position of FIG. 1. When centering and screw head 100 has reached its initial position, it is available for receiving and screwing down a further plug.

What is claimed is:

1. A plug screwing-in device for barrels comprising a centering and screw head having a vertical central axis, said centering and screw head comprising an outer centering ring extending around the central axis and forming an inner open space, a screw head positioned within said outer centering ring within the inner open space, spring means biasing said centering ring in the downward direction and said centering ring being displaceable in the central axis direction relative to said screw head against the biasing action of said spring means, drive means for driving said screw head and extending in the central axis direction, said drive means comprises a drive mechanism located upwardly from said centering and screw head, a drive shaft comprising a first shaft portion having a first end and a second end with the first end connected to said screw head and said first shaft portion extending upwardly from said screw head, a second shaft portion having a first end and a second end with the second end connected to said drive mechanism and extending downwardly therefrom and a universal joint interconnecting the second end of said first shaft portion and the first end of said second shaft portion.

2. A plug screwing-in device, as set forth in claim 1, including a supporting frame spaced upwardly from said centering and screw head, said supporting frame comprising a lower mounting plate and an upper mounting plate spaced upwardly from said lower mounting plate, a centering plate supported on the upper side of said lower mounting plate, said centering plate having an opening therethrough extending in the central axis direction with the surface of said centering plate forming the opening being frustoconically shaped and converging inwardly in the downward direction toward said centering and screw head, said surface defining the opening in said centering plate having a vertical wall section extending downwardly from the lower end of the frustoconically shaped surface to the lower end of said centering plate, a shaped part located within the opening in said centering plate and having a radially outer wall surface extending in the upward direction and being frustoconically shaped converging inwardly in the downward direction and formed complementary to the surface defining the opening in said centering plate, said centering ring is located on the lower end of said shaped part spaced downwardly from said lower mounting plate, said centering ring can be supported on the barrel during the plug centering and screwing-in operation, a guide plate located above said centering plate and connected to the upper end of said shaped part, at least three angularly spaced guide bolts attached to said lower mounting plate and extending upwardly therefrom through said centering plate and said guide plate, and said spring means comprises a spring encircling each of said bolts and extending between said guide plate and a stop surface on said bolts spaced upwardly from said guide plate and said guide plate, said shaped part and centering ring being upwardly displaceable against the biasing action of said springs, and said drive shaft is rotatively supported within said shaped part and said universal joint is located within said drive shaft upwardly from said guide plate.

3. A plug screwing-in device for barrels comprising a centering and screw head having a vertical central axis, said centering and screw head comprising an outer centering ring encircling the central axis and forming an inner open space, a screw head positioned within said outer centering ring within the inner open space, spring means for biasing said centering ring in the downward direction, drive means for driving said screw head, said drive means including a drive shaft extending in the central axis direction, a drive mechanism connected to said drive shaft, and a universal joint located within said drive shaft, a supporting frame located above said centering and screw head, said supporting frame comprising a lower mounting plate and an upper mounting plate spaced upwardly from said lower mounting plate, a centering plate supported on the upper side of said lower mounting plate, said centering plate having an opening therein extending around the central axis and having a wall surface defining the opening with the wall surface being frustoconically shaped and converging inwardly in the downward direction toward said centering and screw head, the lower end of said wall surface extending vertically downwardly from the lower end of said frustoconical surface, the diameter of said vertical wall section of said opening being larger than the diameter of said drive shaft which extends through said opening, a shaped part located within the opening in said centering plate and having an upwardly extending frustoconically shaped outer surface formed complementary to the frustoconically shaped surface of said opening in said centering plate, said centering ring connected to the lower end of said shaped part spaced below said lower mounting plate, said centering ring can be supported on the barrel during the plug centering and screwing-in operations, a guide plate located above said centering plate and secured to said shaped part, at least three upwardly extending guide bolts attached at the lower mounting plate and extending upwardly therefrom through said centering plate and said guide plate, said spring means comprises a spring encircling each of said guide bolts between said guide plate and a stop on said guide bolts spaced upwardly from said guide plate and said centering ring being displaceable upwardly against the biasing action of said springs on said guide bolts, and said drive shaft comprises a first shaft portion having a first end and a second end with the first end connected to said screw head and said first shaft portion extending upwardly from said first end, a second shaft portion having a first end and a second end with the second end connected to said drive mechanism and said second shaft portion extending downwardly from said drive mechanism, and said universal joint located between and interconnecting the second end of said first shaft and the first end of said second shaft.

* * * * *